United States Patent [19]

Jones

[11] Patent Number: 5,012,742

[45] Date of Patent: May 7, 1991

[54] PROXIMITY FUZE

[75] Inventor: Louis F. Jones, Panama City, Fla.

[73] Assignee: The United States of America, as represented by the Secretary of the Navy, Washington, D.C.

[21] Appl. No.: 522,985

[22] Filed: Jan. 25, 1966

[51] Int. Cl.[5] ..... F42B 22/04

[52] U.S. Cl. ..... 102/418; 102/211; 102/215; 114/240 R

[58] Field of Search ..... 102/11, 12, 18, 19.2, 102/70.2, 406, 416, 418, 409, 211, 215; 340/16; 342/68

[56] References Cited

U.S. PATENT DOCUMENTS

| | | | |
|---|---|---|---|
| 2,368,953 | 2/1945 | Walsh | 367/135 |
| 2,404,440 | 7/1946 | Holm | 102/402 |
| 2,405,694 | 8/1946 | Herzmark | 89/41.08 |
| 2,504,118 | 4/1950 | Evans | 89/41.08 |
| 2,807,164 | 9/1957 | Rumbaugh | 73/167 |
| 2,870,427 | 1/1959 | Frank | 342/68 |
| 3,114,145 | 12/1963 | Vielle et al. | 342/30 |

*Primary Examiner*—Charles T. Jordan
*Attorney, Agent, or Firm*—Sol Sheinbein

[57] ABSTRACT

A proximity fuze detects an approaching or attacking torpedo and responds thereto by timely detonating an explosive charge that effectively destroys the torpedo when it is within a predetermined lethal range.

9 Claims, 1 Drawing Sheet

FENCE
SHIP
TORPEDO
EXPLOSIVE TRAIN
CHARGE
EXPL-ODER
ACTU-ATOR
GATE
MEMORY
DELAY
OR
AND
COINCIDENCE CIRCUIT
ANTI-COUNTERMINE CIRCUIT
THRES-HOLDER
TRANS-DUCER
INTE-GRATING THRES-HOLDER

PROXIMITY FUZE

The present invention relates generally to devices for determining the approach or intrusion of a moving object, and, in particular, it is a proximity fuze that detects an approaching or attacking torpedo and responds thereto by timely detonating an explosive charge that effectively destroys the torpedo when it is within a predetermined lethal range.

In the past, passive acoustical energy detecting systems, incorporating electroacoustical transducers which are stationarily disposed about their vertical axes as well as about other axes and which have certain directivity patterns, have been used to destroy enemy torpedoes. The particular directivity patterns used by such systems are such that they usually restrict the detonation of an explosive charge to the time when an approaching torpedo has come within certain limits of position relative thereto.

Although satisfactory for some purposes, the prior art devices appear to leave a great deal to be desired, especially when they are used within a fluid environment which does not inherently prevent rotation of the receiving transducer elements about their respective vertical axes. Thus, the prior art devices have the disadvantage that control the charge detonation has depended upon mechanical stabilization of the proximity fuze against rotation about any axis, and this, in turn, further restricts its uses in general and its delivery or launching systems in particular. The latter, of course, is a factor to be considered, because proper and effective delivery of such a system becomes of paramount importance if, for example, the fuze and charge are to be positioned in the water in front of a running torpedo in such manner that it will be intercepted and destroyed or disabled at some safe distance from a ship to be protected.

The instant invention overcomes many of the disadvantages of the prior art, in that it permits rotation of the subject proximity fuze about its vertical axis and, at the same time, produces localized firing of the explosive charge against an approaching torpedo. And, furthermore, when disposed in a hovering fence-like array, it facilitates and vastly improves the fire power thereof and, thus, improves the ship protection to be obtained therefrom.

It is, therefore, an object of this invention to provide an improved proximity fuze.

Another object of this invention is to provide an improved method and means for protecting a ship or other marine or submarine object from an attacking torpedo.

Still another object of this invention is to provide a proximity fuze that may be suspended within water or any other fluid medium without the necessity of being stabilized about a vertical axis.

A further object of this invention is to provide a proximity fuze that may be disposed in predetermined clusters about or along an object to be protected without adversely interferring with the operation of each other and without inadvertently destroying each other or the object being protected.

A further object of this invention is to provide a proximity fuze that facilitates the launching thereof from the vessel intended to be protected.

Another object of this invention is to provide an improved method and means for detecting the intrusion of an approaching torpedo or other object and timely detonating a charge to effect destruction thereof when it penetrates an optimum lethal region.

Another object of this invention is to provide a proximity fuze that becomes disabled upon receipt of a predetermined shock wave alone and which becomes enabled and detonates a charge upon receipt of both a predetermined target signal and a predetermined shock wave.

Still another object of this invention is to provide an explosive fence between an approaching object and an object to be protected, Another object of this invention is to provide a proximity fuze system that may be easily and economically manufactured, stored, maintained, and operated.

Other objects and many of the attendant advantages will be readily appreciated as the subject invention becomes better understood by reference to the following detailed description when considered in conjunction with the accompanying drawing wherein.

Figures 1, 2, 3, 4:
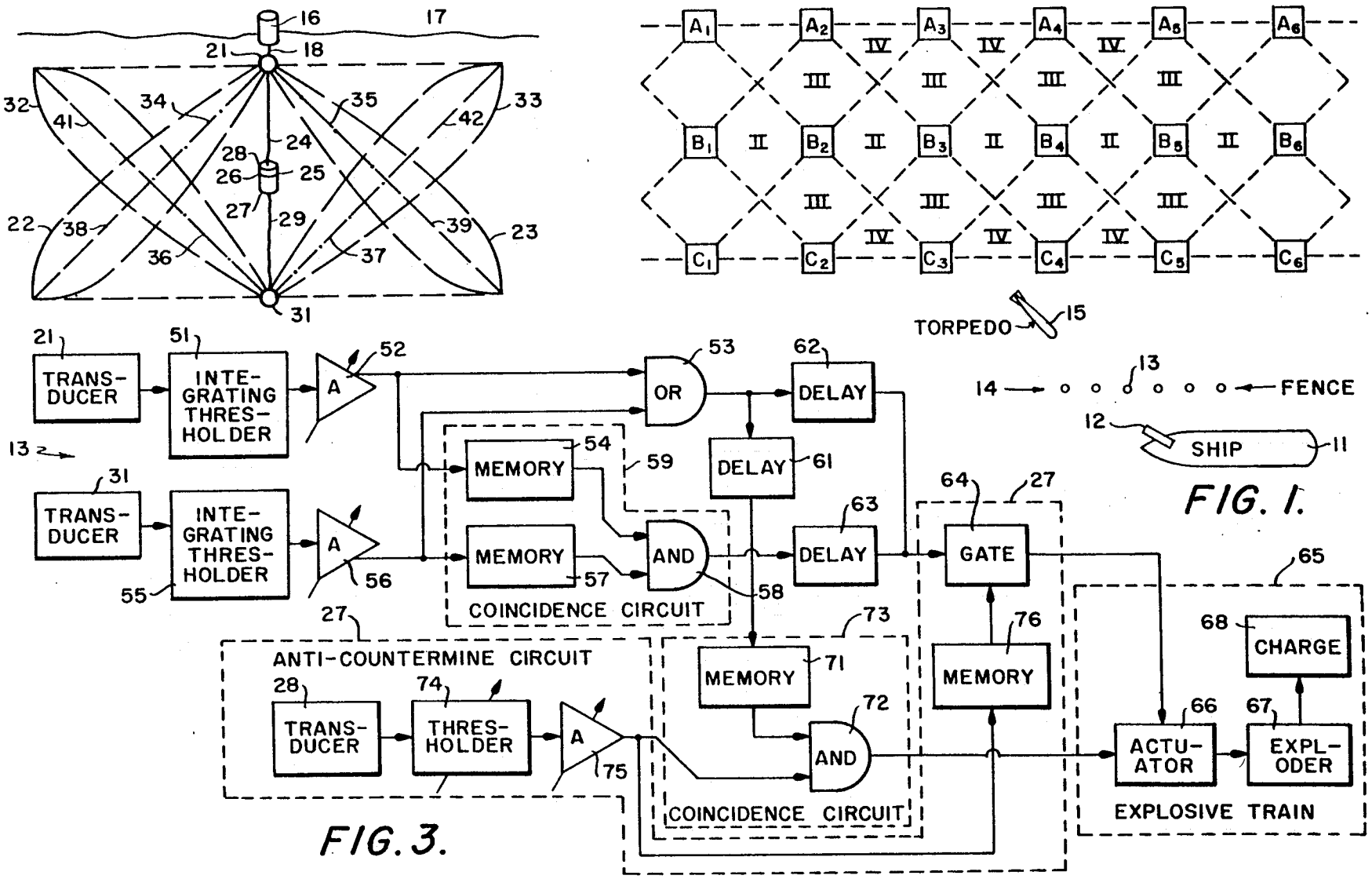
FIG. 1 is a quasi-pictorial top view of the subject invention in operation.
FIG. 2 is an elevational view of the typical disposition of a unitary embodiment of the invention within sea water and the response and detection patterns obtained therein.
FIG. 3 is a block diagram of the subject invention which illustrates the functional logic incorporated therein.
FIG. 4 depicts, in elevational view, an idealized fence constructed of a plurality of the proximity fuze-explosive charge units constituting this invention, with representations of the various interactions that occur therein.

Referring now to FIG. 1, there is symbolically disclosed a top view of a ship 11 having at least one charge-fuze launcher 12 mounted thereon. For most practical purposes, a plurality of launchers will be mounted at various positions around the deck of the ship, so as to provide protection therefor from any direction.

As ship 11 travels along its course, one or more of the charge-proximity fuze units 13 constituting this invention are launched into the sea in such manner that a fence 14 thereof is effectively constructed which, in turn, acts as an explosive barrier to an attacking torpedo 15 and which, in all probability, will destroy it as it arrives within lethal range thereof.

FIG. 2 discloses an elevational view of a single unit of the subject invention in its operational configuration. The essential components include a combination housing and float 16 which is conventionally constructed in such manner as to contain the rest of the apparatus during storage and launching and which ejects the rest of the subject apparatus after being deposited in the sea 17, whereupon it becomes a floating support therefor as is shown. Ejection of the rest of the apparatus may, for example, be effected by an unlatching device which allows it to fall out due to gravity, or it could be forceably ejected by resilient and/or explosive means responsive to sea water, the impact thereon, or any other actuator or trigger.

Suspended by means of a cable 18, attached at the upper end thereof to float 16, is an upper electroacoustical transducer 21 which, by means of well known multi-element construction, is designed to have directivity response patterns that can best be described as a substantially conical or funnel-shaped solid of revolution about its vertical axis. When illustrated in two-dimensional cross-section, as exaggeratedly shown in FIG. 2, lobes 22 and 23 represent the "walls" of said funnel-shaped solid revolution. Lobes 22 and 23 are, in fact, those volumes of sea water within which any object, including a running torpedo, would be sensed or detected by upper transducer 21, regardless of the direction from which it is coming.

Hanging by means of another cable 24 is a suitable container 25 which contains the explosive charge, proximity fuze circuitry 26, the anti-countermeasure circuitry 27, and the shockwave transducer 28, each of which will be discussed in greater detail subsequently in conjunction with FIG. 3. Cable 24 contains those electrical conductors necessary for the interconnection and proper operation of transducer 21 and proximity fuze circuitry 26.

Because container or housing 25 and transducer 28 can best be shown in FIG. 2 as a unit, they are symbolically illustrated and referenced therein as such.

Hanging from container 25 by means of another cable 29 containing suitable electrical conductors is another transducer 31 substantially similar to the aforementioned transducer 21 but inverted as far as physical disposition is concerned. The electrical conductors included in cable 29 are, of course, used for the purpose of connecting transducer 31 to proximity fuze circuitry 26. Transducer 31 is preferably below it due to the pull of gravity, with container 25 and transducer 28 suspended therebetween and substantially in line therewith. In this respect, the casing of transducer 31 can be made heavier or, if so desired, an additional separate weight can be hung on it, in order to keep cables 18, 24, and 29 substantially taut and, thus, maintain, insofar as it is possible, the vertical alignment of said elements current conditions.

Transducer 31, as previously suggested, is to be designed to have a three-dimensional funnel-shaped response pattern similar to that of transducer 21; however, it is positioned so that the increasing diameter funnel walls extend upwards therefrom and intersects the downwardly extending three-dimensional funnel walls of the response pattern of transducer 21. As shown in FIG. 2, vertical cross-sections of said upwardly extending walls appear as lobes 32 and 33.

Short dashed lines 34 through 37 constitute portions of the average center lines of detection lobes 22, 23, 32, and 33, respectively, and, hence, in actual practice, they define a double cone surface which includes an inner volume that encloses the explosive charge at a distance that approximates the primary lethal radius thereof. The long dashed lines 38, 39, 41, 42 (which are respective extensions of short dashed lines 34, 35, 36, and 37), located within the outer extremities of detection lobes 22, 23, 32, and 33, define in actual practice a double frustrum surface that includes an additional outer sensitive volume that is located within a secondary damage radius of the explosive charge.

The latter mentioned double frustrum volume is that location within the sea where a torpedo noise source is expected to cause the subject proximity fuze to initially respond thereto; but, if for some reason or another response thereto fails within this sensitive volume defined by the aforesaid double cone surface, detonation of the explosive charge is effected and the torpedo is destroyed, since it is at that time located within the primary lethal radius thereof.

Referring now to FIG. 3, wherein the block diagram shown incorporates some of the conventional elements already illustrated schematically in one or more of the figures discussed above, respectively, and hence contains the same reference numerals for like elements, there is illustrated transducer 21 with the output thereof coupled to the input of an integrating thresholder 51. In this particular instance, integrating thresholder 51 is a device which averages the voltage of an input electrical signal over a predetermined period of time and produces an output signal when and only when said average exceeds a predesigned magnitude. For convenience in this respect, thresholder 51 is preferably also of the type that may be manually adjusted either during construction and/or operation as desired, in order to facilitate using the subject invention in various different environments. The output of thresholder 51 is coupled to the input of an adjustable amplifier 52 which, likewise should be designed in such manner that an optimum voltage level may be obtained therefrom, depending upon the operational circumstances involved.

The output of amplifier 52 is coupled to one of the inputs of an OR circuit 53 and to the input of any suitable memory device 54 which will retain or prolong the signal supplied thereto for a period of one second. For this purpose, a properly designed monostable multivibrator may be used as memory 54, although it is obvious other conventional elements which perform substantially similar functions would also be suitable for this purpose.

Transducer 31 has its output coupled through a thresholder 55 which is substantially identical in type and function to the aforementioned thresholder 51, and the output thereof is coupled through another amplifier 56 (which is, likewise, substantially identical to the aforesaid amplifier 52) to the input of another one-second memory 57 (which is also substantially identical to the above mentioned memory 54) and, in addition, to the other input of OR circuit 53. The outputs of both memories 54 and 57 are coupled to the inputs of an AND gate 58. As may readily be seen, memories 54 and 57 and AND gate 58 constitute a coincidence circuit 59, as they are arranged in this particular instance.

The output of OR circuit 53 is simultaneously coupled to the inputs of a 0.1 second delay 61 and a 0.5 second delay 62, and the output of AND gate 58 is coupled to the input of a 0.3 second delay 63. The outputs of delays 62 and 63 are interconnected and coupled to the input of a normally closed switch means such as gate 64, which is subject to being timely opened and closed by a predetermined electrical signal obtained from a device that will be discussed subsequently.

The output from gate 64 is applied to the input of a conventional explosive train 65, with the actual input thereof in this particular case being actuator 66. The output of actuator 66 is coupled to an exploder means 67, the output of which is supplied to a charge 68 for the timely detonation thereof.

The output of the aforesaid delay 61 is connected to the input of a 1.0 second memory 71, with the output thereof connected to one of the inputs of an AND gate 72. The output of AND gate 72 is then connected to the input of the aforesaid actuator 66 in such manner as to initiate operation thereof when a signal is supplied thereto. Of course, as may readily be seen, in this particular instance, memory 71 and AND gate 72 constitute another coincidence circuit 73.

Shock transducer 28 located in the above mentioned anti-countermine circuit 27, has its output connected through another thresholder 74. In this particular instance, thresholder 74 may be any suitable device which produces an output signal when some predetermined input signal occurs. For example, it may be a device which produces an output signal when and only when a given level input signal is applied thereto, or it may be a device which produces an output signal when and only when the input signal thereto contains a given rate of voltage rise within a predetermined set of voltage limits. Thus, thresholder 74, when combined with transducer 28, is so constructed as to provide an output signal when and only when a shock wave is received by transducer 28. The output of thresholder 74 is coupled through another adjustable amplifier 75 to the other input of AND gate 72 located in coincidence circuit 73 and to the input of another memory 76 having a 0.7 second memory period. The output of memory 76 is coupled to the control input of the aforesaid gate 64.

At this particular time, it may be noteworthy that amplifiers 52, 56, and 75 are preferably substantially identical in function, although they may be respectively constructed to operate at whatever voltage level is appropriate therefor. In addition, if so desired, amplifiers 52, 56, and 75 may incorporate circuit-isolation circuits in order to optimize the overall operation of the instant invention. Again, as may readily be seen from FIG. 3, the combination of transducer 28, thresholder 74, amplifier 75, memory 76, and the aforesaid gate 64, constitute anti-countermine circuit 27. Furthermore, inasmuch as the output of memory 76 is connected to the control element of gate 64, it should be apparent that the output signal from memory 76 is that signal mentioned above which opens normally closed gate 64, so as to timely prevent an electrical signal from passing therethrough.

Briefly, the operation of the subject invention from the functional standpoint will now be discussed in conjunction with all FIGS.

As shown in FIG. 1, a plurality of combined explosive charges and proximity fuzes 13 (preferably of the type represented in FIG. 3) are launched into the sea by launcher 12, where they are supported by their respective floats at some optimum operational distance from each other and the hull of ship 11 to be protected. Said distances, of course, are determined by the tactical considerations involved in taking both defensive and offensive positions at the time of any given torpedo attack. When launched in the manner illustrated, however, it may readily be seen that they form substantially a line of charges which effectively act as an explosive fence 14 between approaching torpedo 15 and ship 11. Obviously, the launch of said fuze-charge units is predicated on the sighting of an attacking torpedo; and, furthermore, as suggested above, it should be obvious to the artisan that ship 11 would probably make evasive maneuvers, either during or after the charge launchings, as warranted by any given situation, in order to provide optimum defense for said ship.

The fact that the subject invention is portable and may be rapidly launched from the ship to be protected is an important factor to be considered, since the proper positioning thereof at the proper time is usually critical and may mean the difference between life and death of the ship and its complement.

Once launched into the sea, the float, the transducers, the electronic circuit housing, and charge are conventionally separated and take on substantially the configuration indicated in FIG. 2. Thus, it may be seen that float 16 rides on the surface of the water, transducer 21 hangs suspended by cable 18 at some given depth below the surface of the water. Likewise, the unit containing the explosive train, fuze circuitry, and anti-countermine circuitry, including shock responsive transducer 28, is hung at some given intermediate depth from transducer 21 by cable 24, and transducer 31 is hung at some desired lower depth by cable 29. Of course, cables 24 and 29 contain electrical conductors as appropriate to connect transducers 21 and 31 to the remainder of the fuze circuitry, regardless of the depth at which they are disposed during any tactical situation.

It should be understood that any conventional electroacoustical transducers, which have acoustical response patterns substantially similar to those conical patterns depicted in cross-section by lobes 22, 23, 32, and 33 in FIG. 2, should preferably be used in this invention; although it is recognized that for some practical purposes other radiation, detection, or response pattern configurations may also be employed, if the operational circumstances so warrant. Moreover, although the presently disclosed geometrical configuration of the entire subject system (operationally shown in FIGS. 2 and 4) is preferred to fulfill the objectives mentioned above, the invention should not be construed as being limited thereto; accordingly, other configurations may be used, if they would be more effective for other purposes.

As a general rule, more than one explosive unit will be necessary to protect a ship from torpedo attack due to the uncertainty of the actual trajectory thereof. Accordingly, if they are disposed along a line, as illustrated in the top view of FIG. 1, to provide a fence-type configuration, almost certain protection will be effected.

When looking at such fence-type configuration from an elevational standpoint, the upper, center, and lower active elements would appear substantially as ideally shown in FIG. 4. In this figure, the floats were omitted because only the theory of operation is intended to be portrayed therein. As may readily be seen therefrom, if the top blocks referenced as A1 through A6 are considered to be the upper transducers, if the center blocks referenced as B1 through B6 are considered to be the charge and shock transducer units, and if the lower blocks referenced as C1 through C6 are considered to be the lower transducers, an overlapping of detection patterns is effected. Remembering that the outer detection areas are determined by the outer portions of the lobes of the transducers which are directly above and below their respective charges, the outer detection area can be identified by using the symbols of FIG. 4. For example, the outer detection area corresponding to the charge at position $B_3$ (having transducers at positions $A_3$ and $C_3$) can be seen in sectional view as the polygon $A_1$-$A_5$-$B_4$-$C_5$-$C_1$-$B_2$, which is similarly defined by the long-dashed lines of the polygon of FIG. 2. The inner detection area is indicated by the rhombus $A_3$-$B_4$-$C_3$-$B_2$ in FIG. 4, and is also similarly defined by the short-dashed lines of FIG. 2.

Within the over-all detection zone between the upper and lower horizontal boundaries shown in FIG. 4, the areas subdivided by the diagonals represent varying degrees of overlapping coverage; and the Roman Numerals located in these areas, which are projections of various conical operationally responsive surfaces, indicate the number of detection systems covering each such area and, thus, also represent the number of charges that should detonate against a torpedo passing through that particular area. It may be further noted that the number of charges to detonate against one attacking torpedo is disclosed as varying between two and four, with the largest number (four) of detonations being effected at the greatest distance from the charges.

FIG. 4 is, of course, an idealized representation. In actual practice, as a result of placement errors and wave action, statistical irregularities will occur in the horizontal and vertical positions indicated for both the charges and the transducers, as well as in the deviations of the transducer axes from true vertical. Therefore, the degree of coverage provided by an array of the subject fuze-charge units cannot be as uniform and as optimum as depicted in FIG. 4. However, the overlapping coverage obtained from a similar real array tends to insure that at least one charge detonates against the torpedo and that probably more than one will detonate, in the event, for some reason or another, the actuation radius thereof happens to be greater than the lethal radius of a single explosive charge.

The degree of overlapping coverage obtainable from the fence-type array depicted in FIG. 4 is a minimum, if it is considered that the torpedo is making an approach that is perpendicular to the vertical plane thereof. However, an oblique approach of a torpedo running in substantially the horizontal plane would tend to increase the amount of coverage overlap obtained and thereby somewhat favorably modify the aforementioned time-distance factors involved in the detonation control for the explosive charge. Hence, the amount of destructive force applied to an attacking torpedo in such instance would be increased, and the "kill" probabilities would be improved. This, in turn, would, of course, result in better protection being provided for the defending ship.

In a typical array such as that depicted in FIG. 4, transducers having detection cone lobes of seventy-five feet in their respective diagonal directions could be disposed twenty-five feet above and below explosive charges having, for example, a lethal radius of twenty-five feet. And if the explosive charges are horizontally spaced at twenty-five foot intervals and positioned thirty-five feet below the surface of the water, such an array would provide an average of three charges for destructive detonation against a torpedo attacking at an angle of 90° with the vertical plane thereof at random depths between ten and sixty feet. Of course, as previously suggested, an attack from an angle less than 90° with the vertical plane thereof would improve the probabilities of destroying the torpedo.

It is noteworthy that the explosive charge and its associated fuze apparatus are permitted to rotate freely about their respective vertical axes while the proximity fuze portion thereof operates within controlled predetermined limits of lethal range against torpedoes approaching from any direction and having wide variations of sonic output levels. These features are of paramount importance because they vastly improve the defense of ships or the like against torpedoes and other attacking missiles or objects.

The operation of the subject invention will now be discussed briefly from the electronic standpoint, primarily in conjunction with FIGS. 2 and 3. In this discussion, a number of exemplary situations which may occur when the sound of an approaching torpedo is received will be treated.

First, assume the situation where an attacking torpedo is running at such a depth that it has entered the outer sensitive zone represented by outer extremity of lobe 23. The sound it makes is then received by upper transducer 21. Being an electroacoustical transducer, an electrical signal is produced at the output thereof which is supplied to thresholder 51. In event the level of this signal is sufficient to be an actual torpedo sound, rather than some spurious sea noise, thresholder 51, in turn, passes it to amplifier 52, where it is amplified to a more useful level. This amplified signal is then applied to OR circuit 53 and immediately passes on to delays 61 and 62. In these delays, the signal is delayed for 0.1 second and 0.5 second, respectively.

While all this is taking place, the torpedo probably continues its approach and shortly thereafter, depending on the running depth L and direction, may enter the inner sensitive zone represented by lobe 33, whereupon its sound is received by lower transducer 31. On the other hand, if for some reason or another the torpedo should discontinue its attack approach due to turning or stopping, or should it only pass through the aforesaid outer sensitive zone, the aforementioned electrical signal, after a 0.5 second delay, will be passed through normally open gate 64 to actuate explosive train 65, detonating charge 68. The 0.5 second delay is incorporated in this particular preferred embodiment in order to allow the torpedo to continue its run toward the explosive charge and, therefore, be in a more vulnerable position as a result of being in closer proximity thereto when detonation occurs. Thus, it can be seen that charge 68 will be exploded when the torpedo is in substantially the most lethal proximity thereof during any given operational circumstance, and this is true even if the torpedo has deviated for some unknown reason from its original attack trajectory.

In event the torpedo has not already been destroyed or did not deviate from its original attack trajectory, as mentioned above, it subsequently enters the inner sensitive zone monitored by lower transducer 31. Like transducer 21, transducer 31 is an electroacoustical transducer and, therefore, supplies an electrical signal to thresholder 55. Again, if the signal is of predetermined level and of the type indicating the presence of a torpedo, it is further amplified by amplifier 56 and then supplied to memory 57, where it is prolonged in such manner as to be constantly applied to AND gate 58 for one second.

In addition to being supplied to OR circuit 53, the output of amplifier 52 was also applied to memory 54, where it was prolonged in such manner as to be constantly applied to AND gate 58 for one second. Memories 54 and 57 both are preferably designed to have one second memory periods, so as to allow time for the torpedo to it is going to do so. However, as can be seen, if no torpedo signal is timely received in this particular case by transducer 31, the transducer 21 signal becomes the actuating signal; but if the torpedo sound is received by both transducers 21 and 31 prior to the expiration of the delay time of delay 62, viz., 0.5 second, inputs to AND gate 58 will occur concomitantly and AND gate 58 will produce an output signal that is applied to 0.3 second delay 63.

Delay 63 is preferably incorporated in this invention in order to make it more effective, since in the case where the responsive lobes of both transducers are penetrated, it allows the attacking torpedo to continue its run long enough to be closer to the explosive charge in the average attack situation and, therefore, be in a more vulnerable position, before the charge is detonated.

Substantially the same procedure occurs in the event the torpedo is attacking from such a depth that lobe 33 is penetrated first, with the exception that in such instance lower transducer 31 becomes the initiator of first actuating signal.

Another situation is possible, of course, and this is where the torpedo attacks at a depth where the upper and lower extending response lobes intersect. In such case, the procedure is the same as that mentioned above, where both transducers 21 and 31 have received the sound of the approaching torpedo.

Obviously, many similar and/or opposite situations may occur which will cause the subject proximity fuze to effectively function in substantially the same manner. Moreover, it may be noteworthy that the invention will work, even if the attacking torpedo makes its approach with an upwardly or downwardly inclined trajectory.

Another important feature of this invention is the incorporation of the anti-countermine circuit. The purpose of this circuit is two fold: (1) to disable the subject fuze if a shock wave alone is received thereby; and (2) to immediately detonate the explosive charge in the event a shock wave arrives at the fuze at some predetermined time shortly after a torpedo signal has been received thereby.

Fulfilling the aforesaid first mentioned purpose of the anti-countermine circuit is desirable because it prevents the detonation of those explosive charges disposed in the "fence" which are not located within lethal or damaging distance of the torpedo at the time one or more of the others are detonated; and fulfilling the aforementioned second purpose is desirable in order to effect immediate detonation of the explosive charge whenever the torpedo is possibly within lethal or damaging range, so as to effect multiple shots at it and thus increase the probabilities of destroying it, though it has already been shot by an already detonated explosive charge from another fuze adjacently or proximately disposed with the protective "fence." The latter situation, of course, provides double or possibly triple insurance that the attacking torpedo will be destroyed or neutralized before it reaches its target ship.

The first mentioned result effected by the anti-countermine circuit occurs because, when only a shock wave is received, transducer 28 produces a signal that is supplied to thresholder 74. As previously mentioned, thresholder 74 is so designed as to function only when some predetermined signal, such as, for example, a given rate of rise of signal voltage or given voltage amplitude or both, occurs which indicates the presence of a shock wave condition only. When this occurs, an output signal is produced thereby, which is amplified to a more useful level by amplifier 75, and then applied to memory 76, where it is prolonged for 0.7 second. This prolonged signal is, of course, immediately applied to the control element of gate 64 and holds it open for 0.7 second, thereby preventing an output signal from delays 62 and 63 (occurring as a result of the shock wave also impacting on either or both of receiving transducers 18 and 31, as well as on shockwave transducer 28) from untimely energizing explosive train 65. Hence, it may be seen that a shock wave alone effectively disables the entire proximity fuze system and prevents the useless detonation of the explosive charge, thereby fulfilling the aforementioned first purpose of the anti-countermine circuit.

The second mentioned result effected by the anti-countermine circuit occurs because not only a shock wave has been received thereby (as a result of the detonation of some other explosive charge in the "fence") but, in addition, either or both of receiving transducers 18 and 31 have already received the torpedo signal as a result of its relatively close proximity thereto and, therefore, have already started a signal through the subject fuze system. Thus, an output signal from either or both of said receiving transducers is supplied to OR circuit 53, from which it is immediately supplied to delay 61, where it is delayed for 0.1 second. In this particular instance, then, a 0.1 second delay is used to prevent charge detonation as a result of the simultaneous operation of the receiving portion of the subject fuze and its associated anti-countermine circuit which would otherwise occur only when a shock wave is present. This, then, allows the fuze to be disable for the very, very short period of time it takes for a shock wave to pass, but shortly thereafter (0.1 second) it again becomes enabled and responsive to torpedo sounds.

After the 0.1 second delay, the OR circuit signal is supplied to memory 71, where it is prolonged for 1.0 second, so as to be applied to one of the inputs of AND gate 72 for that length of time. But if a signal is simultaneously applied to the other input of AND gate 72 as a result of a shock wave being received by transducer 28, AND gate 72 then produces an output signal that energizes explosive train 65, which, of course, includes detonation of explosive charge 68. This procedure then causes multiple shots to occur in a attacking torpedo, which obviously, considerably increases the probabilities of destroying it before it reaches the ship to be protected.

It should be understood that, although the subject invention is herein described as being an exceedingly useful item for protecting ships from torpedoes, it should be apparent that it could also be used in water to protect other types of vessels or objects from other types of marine or submarine vehicles, if so desired. Furthermore, if warranted by the circumstances, this invention concept could be incorporated in a similar fuze-charge system suspended in air by any suitable balloon, float, or stationary support tower structure for the purpose of protecting land or airborne objects, since so doing would obviously be well within the purview of one skilled in the art having the benefit of the teachings herewith presented.

It would appear to be noteworthy that the aforementioned time periods respectively incorporated in the delay lines and memory devices of the system of FIG. 3 are based on typical torpedo speeds. Accordingly, it should be understood that they are representative only, and that the subject invention is not limited thereto, inasmuch as it would be well within the purview of one skilled in the art having the benefit of the teachings herewith presented to make other design selections thereof that will cover other devices, attacking at other speeds and under other circumstances.

It would appear to be noteworthy, too, that each of the elements represented in block form in FIG. 3 is well known and conventional per se; accordingly, it is their interconnections and interactions that constitute the subject invention and produces the results described herein.

Obviously, many other modifications and embodiments of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. A proximity fuze system comprising in combination: a pair of spatially disposed transducers; an explosive means;

first means effectively interconnecting the outputs of said pair of transducers and the input of said explosive means for effecting the detonation thereof at a predetermined time after a given signal is received by either of said transducers; and second means effectively interconnecting the outputs of said pair of transducers and the input of said explosive means for effecting the detonation thereof within a predetermined time after said given signal is received by both of said pair of transducers, if it has not already been detonated by the aforesaid first means.

2. The device of claim 1 wherein said first means effectively interconnecting the outputs of said pair of transducers and the input of said explosive means for effecting the detonation thereof at a predetermined time after a given signal is received by either of said transducers comprises:

an OR circuit having a pair of inputs and an output, with the inputs thereof respectively connected to the outputs of said pair of spatially disposed transducers; and delay means effectively connected between the output of said OR circuit and the input of said explosive means for delaying the detonation thereof a predetermined time period.

3. The device of claim 1 wherein said second means effectively interconnecting the outputs of said pair of transducers and the input of said explosive means for effecting the detonation thereof within a predetermined time after said given signal is received by both of said pair of transducers, if it has not already been detonated by the aforesaid first means, comprises:

a first memory effectively coupled to the output of one of said pair of spatially disposed transducers;

a second memory effectively coupled to the output of the other of said pair of spatially disposed transducers;

an AND gate having a pair of inputs and an output, with the inputs thereof respectively connected to the outputs of said first and second memories; and delay means effectively connected between the output of said AND gate and the input of said explosive means for delaying the detonation thereof a predetermined time period.

4. The device of claim 1 wherein said explosive means comprises: an actuator; an exploder connected to the output of said actuator; and an explosive charge connected to said exploder.

5. The invention according to claim 1 further characterized by:

a normally open gate having an input, an output, and a control element, with the input thereof connected to the outputs of said first and second detonation effecting means and the output thereof connected to the input of said explosive means;

a third transducer;

third means connected between the output of said third transducer and the control element of said normally open gate for the closing thereof in response to a shockwave received by all of the aforesaid transducers; and fourth means connected to said first and third means and to the input of said explosive means for immediate detonation thereof when said given signal and said shockwave are successively and respectively received by either of said pair of spatially disposed transducers and said third transducer within a predetermined time period, whenever said explosive means has not already been detonated by the aforesaid first means.

6. The device of claim 5 wherein said third means connected between the output of said third transducer and the control element of said normally open gate for the closing thereof in response to a shockwave received by all of the aforesaid transducers comprises:

thresholder means connected to the output of said third transducer for passing only a signal having the rapid rate of voltage rise characteristics of a shockwave; and a memory means effectively connected between the output of said thresholder means and the control element of said gate.

7. The device of claim 5 wherein said fourth means connected to said first and third means and to the input of said explosive means for immediate detonation thereof when said given signal and said shockwave are successively and respectively received by either of said pair of spatially disposed transducers and said third transducer within a predetermined time period, whenever said explosive means has not already been detonated by the aforesaid first means, comprises:

thresholder means connected to the output of said third transducer for passing only a signal having the rapid rate of voltage rise characteristics of a shockwave;

a delay means connected to said first detonation effecting means;

a memory means connected to the output of said delay means;

an AND gate having a pair of inputs and an output, with one of the inputs thereof connected to the output of said memory means, the other input thereof effectively connected to the output of said thresholder means, and the output thereof connected to the input of the aforesaid explosive means.

8. A proximity fuze system comprising in combination:

a sealed float chamber adapted for floating on the surface of sea water;

a first receiving transducer, having a downwardly extending hollow conical response pattern, suspended a predetermined distance below said sealed float chamber and supported thereby;

a shockwave transducer, having a substantially omnidirectional response pattern, suspended a predetermined distance below said first receiving transducer and supported thereby;

a second receiving transducer, having an upwardly extending hollow conical response pattern which intersects with the downwardly extending hollow conical response pattern of said first receiving transducer, suspended a predetermined distance below said shockwave transducer and supported thereby;

a first adjustable thresholder connected to the output of said first receiving transducer;

a second adjustable thresholder connected to the output of said second receiving transducer;

an OR circuit having a pair of inputs and an output, with one of the inputs thereof effectively connected to the output of said first adjustable thresholder, and the other input thereof effectively connected to the output of said second adjustable thresholder;

a first delay means, having a predetermined signal delay period, coupled to the output of said OR circuit;

a first memory means, having a predetermined signal prolonging period, coupled to the output of said first adjustable thresholder;

a second memory means, having a signal prolonging period equal to that of said first memory means, coupled to the output of said second adjustable thresholder;

a first AND gate having a pair of inputs and an output, with one of the inputs thereof connected to the output of said first memory means, and the other input thereof connected to the output of said second memory means, a second delay means, having a signal delay period less than that of said first delay means, connected to the output of said first AND gate;

a normally open gate having an input, an output, and a control element, with the input thereof connected to the outputs of said first and second delay means, and the control element adapted for the closing thereof in response to a predetermined signal;

an explosive charge disposed within said sea water effectively connected to the output of said gate adapted for being detonated in response to a signal passing therethrough;

a third adjustable thresholder connected to the output of said shockwave transducer;

a second AND gate having a pair of inputs and an output, with one of the inputs thereof effectively coupled to the output of said third adjustable thresholder;

a third delay means, having a delay period less than the delay periods of said first and second delay means, connected to the output of the aforesaid OR circuit;

a third memory means, having a signal prolonging period equal to those of said first and second memory means, connected between the output of said third delay means and the other input of said second AND gate; and a fourth memory means, having a signal prolonging period less than those of said first, second, and third memory means, effectively connected between the output of said third thresholder and the control element of the aforesaid normally open gate.

9. A proximity fuze-explosive charge array adapted for timely providing an explosive fence between a ship to be protected and an attacking torpedo comprising in combination:

a plurality of proximity fuze-explosive charge units disposed in such predetermined spatial configuration within the water along the side of said ship as to effect interacting torpedo detection and destruction patterns in the probable trajectory path thereof, with each of said units comprising:

a sealed float chamber adapted for floating on the surface of sea water;

a first receiving transducer, having a downwardly extending hollow conical response pattern, suspended a predetermined distance below said sealed float chamber and supported thereby;

a shockwave transducer, having a substantially omnidirectional response pattern, suspended a predetermined distance below said first receiving transducer and supported thereby;

a second receiving transducer, having an upwardly extending hollow conical response pattern which intersects with the downwardly extending hollow conical response pattern of said first receiving transducer, suspended a predetermined distance below said shockwave transducer and supported thereby;

a first adjustable thresholder connected to the output of said first receiving transducer;

a second adjustable thresholder connected to the output of said second receiving transducer;

an OR circuit having a pair of inputs and an output, with one of the inputs thereof effectively connected to the output of said first adjustable thresholder, and the other input thereof effectively connected to the output of said second adjustable thresholder;

a first delay means, having a predetermined signal delay period, coupled to the output of said OR circuit;

a first memory means, having a predetermined signal prolonging period, coupled to the output of said first adjustable thresholder;

a second memory means, having a signal prolonging period equal to that of said first memory means, coupled to the output of said second adjustable thresholder;

a first AND gate having a pair of inputs and an output, with one of the inputs thereof connected to the output of said first memory means, and the other input thereof connected to the output of said second memory means;

a second delay means, having a signal delay period less than that of said first delay means, connected to the output of said first AND gate;

a normally open gate having an input, an output, and a control element, with the input thereof connected to the outputs of said first and second delay means, and the control element adapted for the closing thereof in response to a predetermined signal;

an explosive charge disposed within said sea water effectively connected to the output of said gate adapted for being detonated in response to a signal passing therethrough;

a third adjustable thresholder connected to the output of said shockwave transducer;

a second AND gate having a pair of inputs and an output, with one of the inputs thereof effectively coupled to the output of said third adjustable thresholder;

a third delay means, having a delay period less than the delay periods of said first and second delay means, connected to the output of the aforesaid OR circuit;

a third memory means, having a signal prolonging period equal to those of said first and second memory means, connected between the output of said third delay means and the other input of said second AND gate; and a fourth memory means, having a signal prolonging period less than those of said first, second, and third memory means, effectively connected between the output of said third thresholder and the control element of the aforesaid normally open gate.

* * * * *